US005904071A

United States Patent [19]

Kennedy et al.

[11] Patent Number: 5,904,071

[45] Date of Patent: May 18, 1999

[54] PISTON ROD ASSEMBLY

[75] Inventors: George Coulter Kennedy, Kilmacolm; Steven Flindall, Glen Garnock, both of United Kingdom

[73] Assignee: T M Kennedy & Company Limited, Kilmacolm, United Kingdom

[21] Appl. No.: 08/788,510

[22] Filed: Jan. 24, 1997

[30] Foreign Application Priority Data

Jan. 24, 1996 [GB] United Kingdom ..... 9601399

[51] Int. Cl.[6] ..... G05G 1/00

[52] U.S. Cl. ..... 74/579 R; 92/134

[58] Field of Search ..... 74/579 E, 579 M, 74/579 R, 60, 335, 364; 92/12.2, 71, 91, 24, 134

[56] References Cited

U.S. PATENT DOCUMENTS

| | | | |
|---|---|---|---|
| 3,110,522 | 11/1963 | Bunch | 74/512 X |
| 3,543,512 | 12/1970 | England et al. | 92/134 |
| 3,695,731 | 10/1972 | England et al. | 92/134 |
| 4,809,731 | 3/1989 | Walton et al. | 92/60.5 |

FOREIGN PATENT DOCUMENTS 2190170 11/1987 United Kingdom .

*Primary Examiner*—Vinh T. Luong
*Attorney, Agent, or Firm*—Ratner & Prestia

[57] ABSTRACT

A piston rod assembly has a release link connector (12) coupled to a power end component (10) and a fluid end component (11). The connector (12) allows quick release of the assembly and includes one or more tension links (15,20) which do not extend or protrude beyond the axial limit of the ends of the body (13) of the connector (12).

11 Claims, 6 Drawing Sheets

PISTON ROD ASSEMBLY

FIELD OF THE INVENTION

This invention relates to high pressure reciprocating pumps such as those used to pump drilling mud in the oil production industry, including those pumps commonly referred to in the industry as mud and slush pumps.

It is necessary with high pressure reciprocating pumps to replace the piston or other dynamic component with relative regularity and it is therefore advantageous if this task can be performed quickly and easily.

The piston forms one of the components in the fluid end of a piston rod assembly in a reciprocating pump. Typically, it is fixed to a piston link which is connected to an extension rod or other component at the power end of the pump by a connector.

An object of the present invention is to provide an improved connector which is more durable and which facilitates an efficient replacement of worn pistons, plungers or the like, and the make-up and disassembly of piston rod assemblies generally.

DESCRIPTION OF THE PRIOR ART

In UK Patent No 2 190 170 there is disclosed a piston rod assembly for an High Pressure Reciprocating Pump, comprising a power end component, a fluid end component and a connector releasably connected to said end components, said connector having a pair of tension links extending therefrom and having coupling means to co-operate with coupling means on the end components, and means within the connector for causing movement of the links against tension to move into co-operative disposition with the end components to permit coupling or uncoupling and for returning the links under tension to secure the components when coupled against release.

It is notable in this earlier patent that the tension links extend beyond the axial limits, that is the end walls 14, of the body 13 of the connector. In the present invention it is recognised that this is disadvantageous for various reasons, including that the tension links are more likely to be damaged, given their hollow structure, if protruding axially, and that the connector is less compact. Also a male tension link which protrudes beyond the end wall of the body of the connector may damage the rubbing surface of a plunger, for example, in a stuffing box.

SUMMARY OF THE INVENTION

According to the present invention there is provided a piston rod assembly comprising a connector releasably connected between a power end component and a fluid end component, said connector having a body member and first and second tension links, wherein each link has a coupling pin to co-operate with respective apertures on the end components, the connector further including biasing means for biasing the links, when coupled, in shear to resist uncoupling thereof and a means for causing movement of the one or more links against said bias to enable their movement into co-operative disposition with the end components to permit coupling or uncoupling, characterised in that at least one of the links does not extend beyond the axial limit of the body.

Preferably there is a first said tension link which is free to rotate about the longitudinal axis of the connector, relative to the connector, and a second said tension link which is restrained from rotating about the longitudinal axis of the connector.

Preferably the biasing means comprises mechanical springs; most suitably disc springs, while the means for causing movement of the one or more links against said bias includes a pressurising fluid, the pressure of which acts on the one or more tension links.

The means for causing movement of two tension links may comprise a pair of pistons with the heads thereof disposed in back to back relation, said pistons being attached to or integral with said tension links, and means for forcing the pistons apart comprising a chamber located between the piston heads, the chamber being supplied with pressurised fluid. Alternatively mechanical apparatus could be used to force the pistons apart.

Preferably the tension link which is free to rotate is sandwiched between a piston component and a shoulder component enabling the tension link to rotate while the piston is under pressure from the pressurising fluid.

The apertures in the two tension links may be adapted to be aligned with respective apertures in the power end and fluid end components, and one or more respective coupling pins sized to be received and located in the aligned apertures.

Preferably the tension link and respective end component are coupled together in a male/female formation. Both tension links may be female and not extend beyond the axial limits of the body of the connector.

The fluid end component may be a piston link which is coupled to the connector, wherein the piston link supports a piston which is retained on the piston link by a mechanical retainer, wherein the mechanical retainer and piston link are forcibly biased relative to the piston in a direction adapted to tighten the retainer on the piston link, and wherein means is provided for causing movement when desired of the piston link and mechanical retainer against said bias to assist in the removal of said retainer and thereafter said piston from said piston link.

Preferably the retainer is a nut threaded on the piston link.

The means for causing movement of the piston link preferably comprises a chamber adapted to receive pressurised fluid or locate mechanical compressive apparatus.

Preferably a dowel is mounted in said piston link which engages a recess in said stud piston for preventing rotation of the piston link.

Preferably the piston rod assembly is associated with a fluid inlet/outlet device for supplying pressure fluid into or out of the chamber between the pistons of the connector or the chamber behind the piston of the piston link, wherein the fluid inlet/outlet device comprises, in combination, a filling body having one or more radial fluid outlet passages associated with a central passage for the injection of fluid into internal openings of the radial passages in the filling body and an inlet nozzle for injecting pressurised fluid into the filling body, said nozzle being adapted for location in the central passage of the filling body and having a longitudinal fluid inlet passage which bends through an angle to exit from the side of the nozzle between two pressure seals and align with the radial fluid inlet passage of the filling body, the nozzle also having a separate pressure equalising bleed hole which extends through the nozzle from the end of the nozzle when it is pushed into the body.

Preferably the coupling pin is attached to a wash pipe.

BRIEF DESCRIPTION OF THE DRAWINGS

An embodiment of the present invention will now be described by way of example, with reference to the accompanying drawings, in which.

DESCRIPTION OF THE PREFERRED EMBODIMENTS

Figure 1:
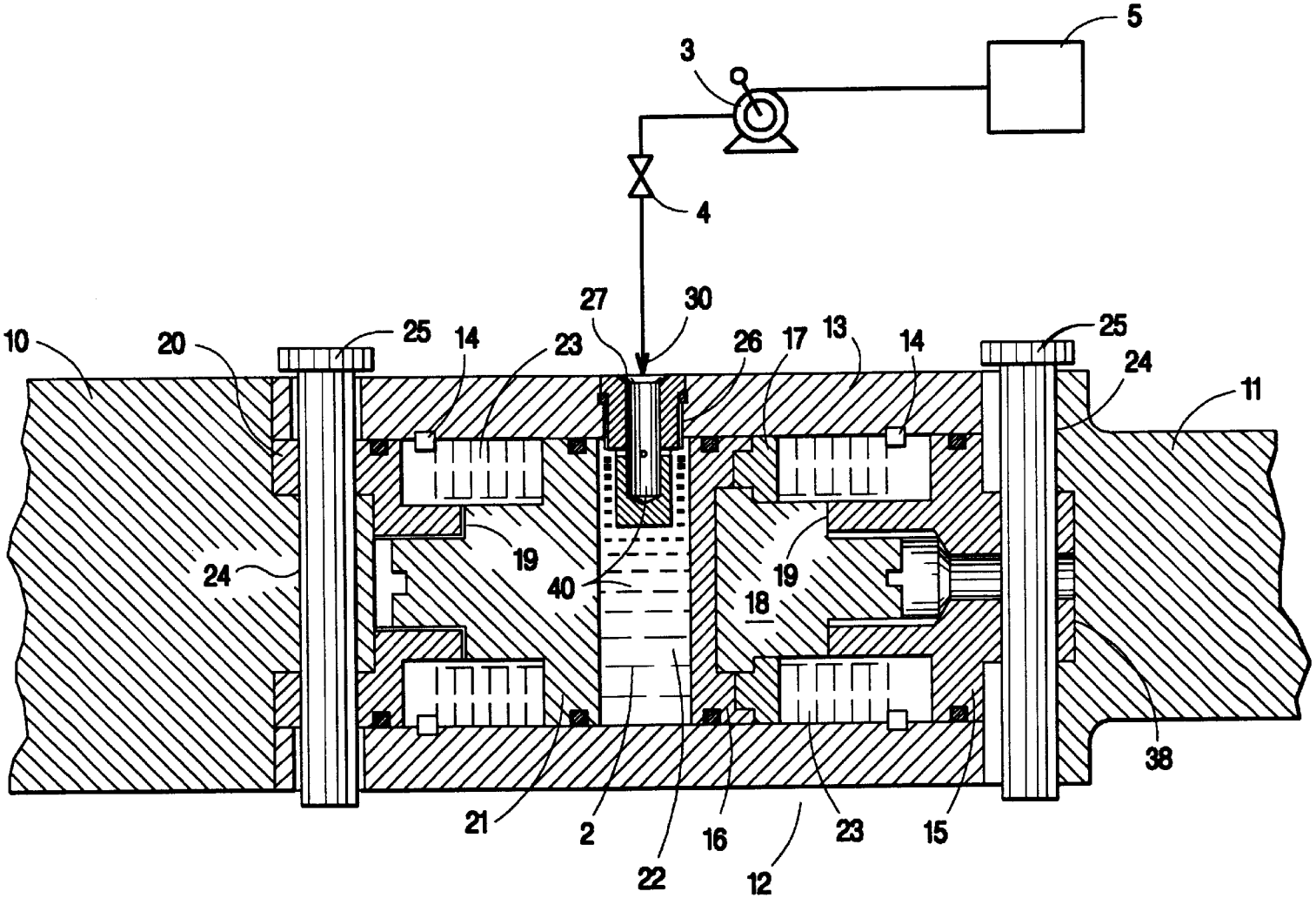
FIGS. 1 and 1*a* are sectional side elevations of part of a piston rod assembly which can be used in a high pressure reciprocating pump according to the invention, showing a connector coupled to a fluid end component and a power end component.
Figure 2:
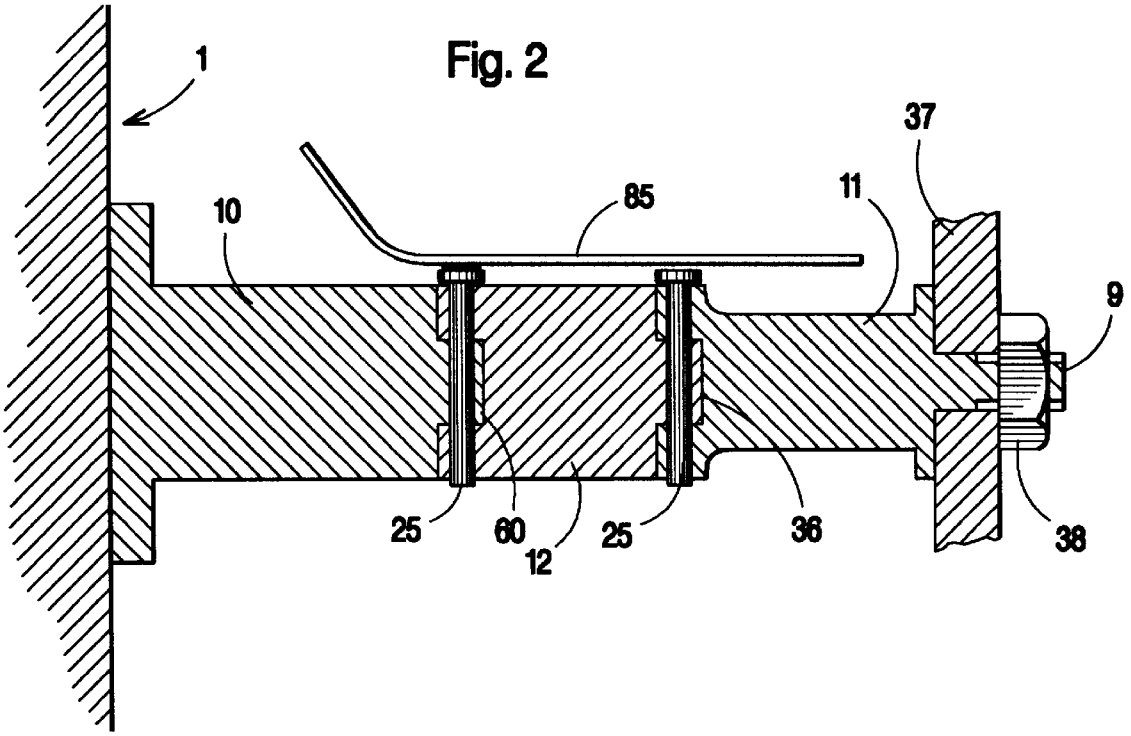
FIGS. 2 and 2A are sectional side elevations of the whole of a piston rod assembly, ie the piston link with the piston mounted, the release link and the cross head extension rod. It also shows a wash water pipe.

Referring firstly to FIGS. 1 and 2, a piston rod assembly which can be used in a high pressure reciprocating oilfield mud pump comprises of a cross head extension rod 10, a piston link 11 and a release link connector 12 connecting the two end components 10, 11.

The release link connector 12 has a cylindrical body 13 and two spring retainers 14. A male tension link 15 projects axially from one end of the release link connector 12. The male link 15 is the rotatable outer portion of a piston 16 and is connected to the piston 16 by means of a shoulder 17, a swivel link 18 and adjustment shims 19. A female tension link 20 is contained axially within the body 13 at the opposite end to that containing the male link 15. The female link 20 is the outer portion of a non rotating piston 21. Pistons 16 and 21 are located within the body 13 in back-to-back relation such that a chamber 22 is provided between the two pistons 16 and 21. Spring means, such as disc springs 23 between the respective pistons 16 and 21 and spring retainers 14 resist outward movement of the pistons 16, 21. Thus, the pistons 16, 21 are normally in their withdrawn position with the links 15 and 20 being pushed by the springs 23 into the body 13.

When chamber 22 is pressurised by fluid 40 the pistons 16 and 21 are forced outwards for a short distance just sufficient to bring a pin aperture 24 in each link into register with a similar opening in the two end components 10, 11 after which a pin 25 is inserted into each of the through apertures 24.

When pressure in the chamber 22 is released by removal of fluid 40, the pistons 16, 21 are pushed inwards by the springs 23 thus placing in shear the pins 25 and retaining the end components 10, 11 securely attached to the connector 12. The operation of coupling the end components 10, 11 to the release link connector 12 takes approximately thirty seconds. To uncouple, the chamber 22 is again pressurised to release the shear force on the locking pins 25 which can then be easily removed out of the apertures 24. The couplings can be removed, the piston changed, and the rod re-assembled in less than five minutes.

Figure 1A:
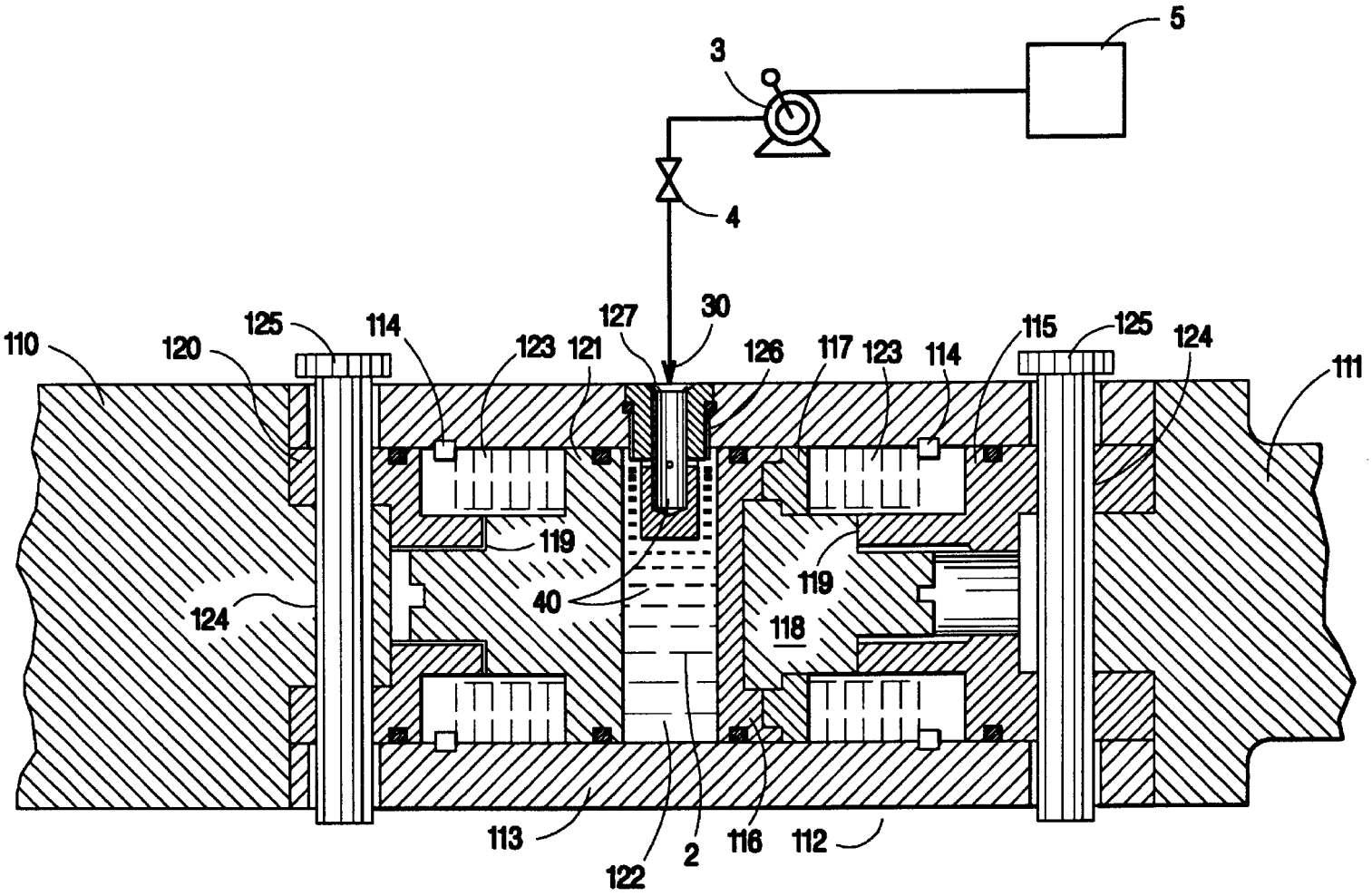
Figure 2A:
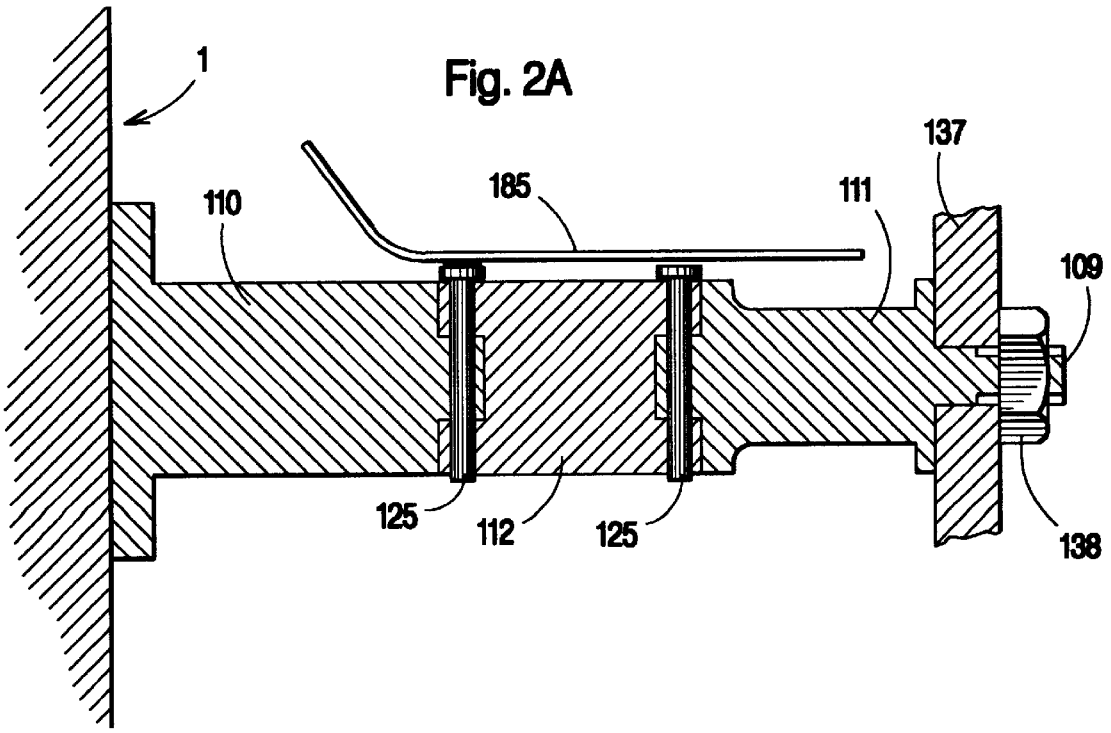

Alternatively referring to FIGS. 1A and 2A the release link connector 112 has a cylindrical body 113 and two spring retainers 114. A male tension link 115 is contained axially within one end of the release link 112. The link 115 is in the rotatable outer portion of piston 116 and is connected to the piston 116 by means of a shoulder 117, a swivel link 118 and adjustment shims 119. A female tension link 120 is contained axially within the body 113 at the opposite end to that containing the link 115. Link 120 is the outer portion of a non rotating piston 121. Pistons 116 and 121 are located within the body 113 in back-to-back relation such that a chamber 122 is provided between the two pistons 116 and 121.

Referring again to FIG. 6, the piston link 11 has an axial, outwardly extending stud 9 on which is mounted a piston head 37 secured by a retaining nut 38. The stud 9 is in the outer portion of a stud piston 70. Stud piston 70 is located within the piston link 11 such that a chamber 71 is provided between the stud piston 70 and the bottom of a cylinder 72 bored axially in the piston link 11. Spring means such as disc springs 23 between the stud piston 70 and a spring retainer 73 resist outwards movement of the piston. Thus the piston is normally in its withdrawn position with the stud 9 being pushed by the springs 23 into the piston link 11. When the chamber 71 is pressurised by fluid 40 the stud piston 70 is forced outwards for a short distance just sufficient to allow the tension on the stud 9 to be reduced enough to be able to easily release the nut 38. When the pressure in chamber 71 is released the stud piston 70 is pushed inwards by the springs 23 thus placing in tension the stud 9 and hence securely attaching the piston head 37 to the piston link 11 with the nut 38. To release the nut 38 and hence the piston head 37, the chamber 71 is again pressurised to release the tension on the stud 9 so that the nut 38 can be easily removed. The piston can be removed and changed in seconds. The tension on the stud 9 is predetermined by designing the spring force to equate with the required nut tightening torque. A dowel 75 prevents unwanted rotation of the stud piston 70 within the cylinder 72.

Figure 3:
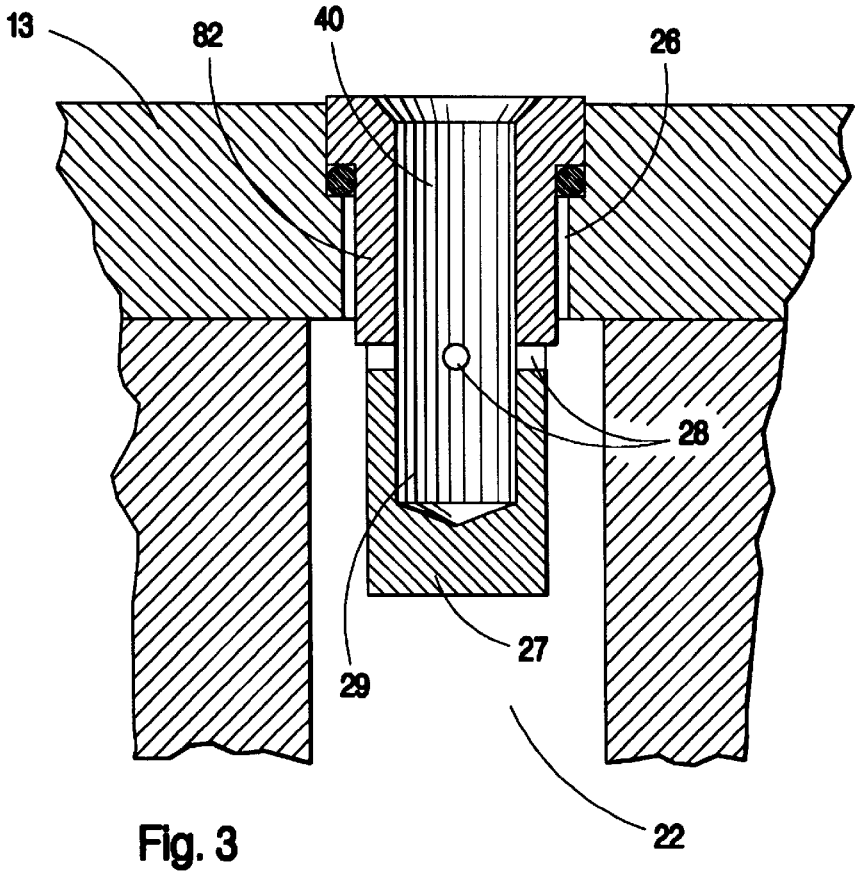
FIG. 3 is a sectional detail showing a high pressure quick release fitting which serves as the fluid inlet/outlet device in the connector of the piston rod assembly.
Figure 4:
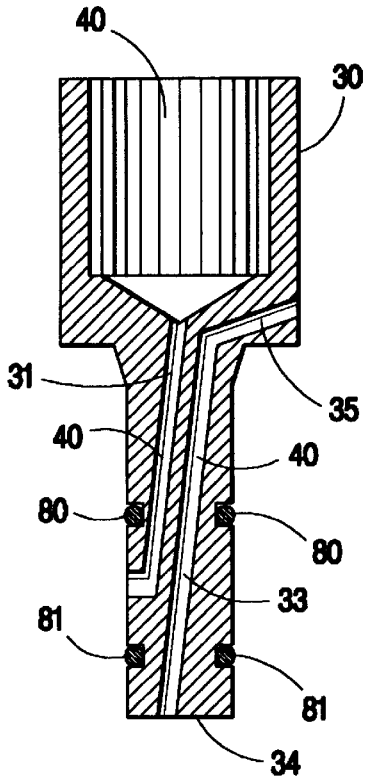
FIG. 4 is a sectional detail showing the pressure source nozzle for location in the fluid valve.
Figure 5:
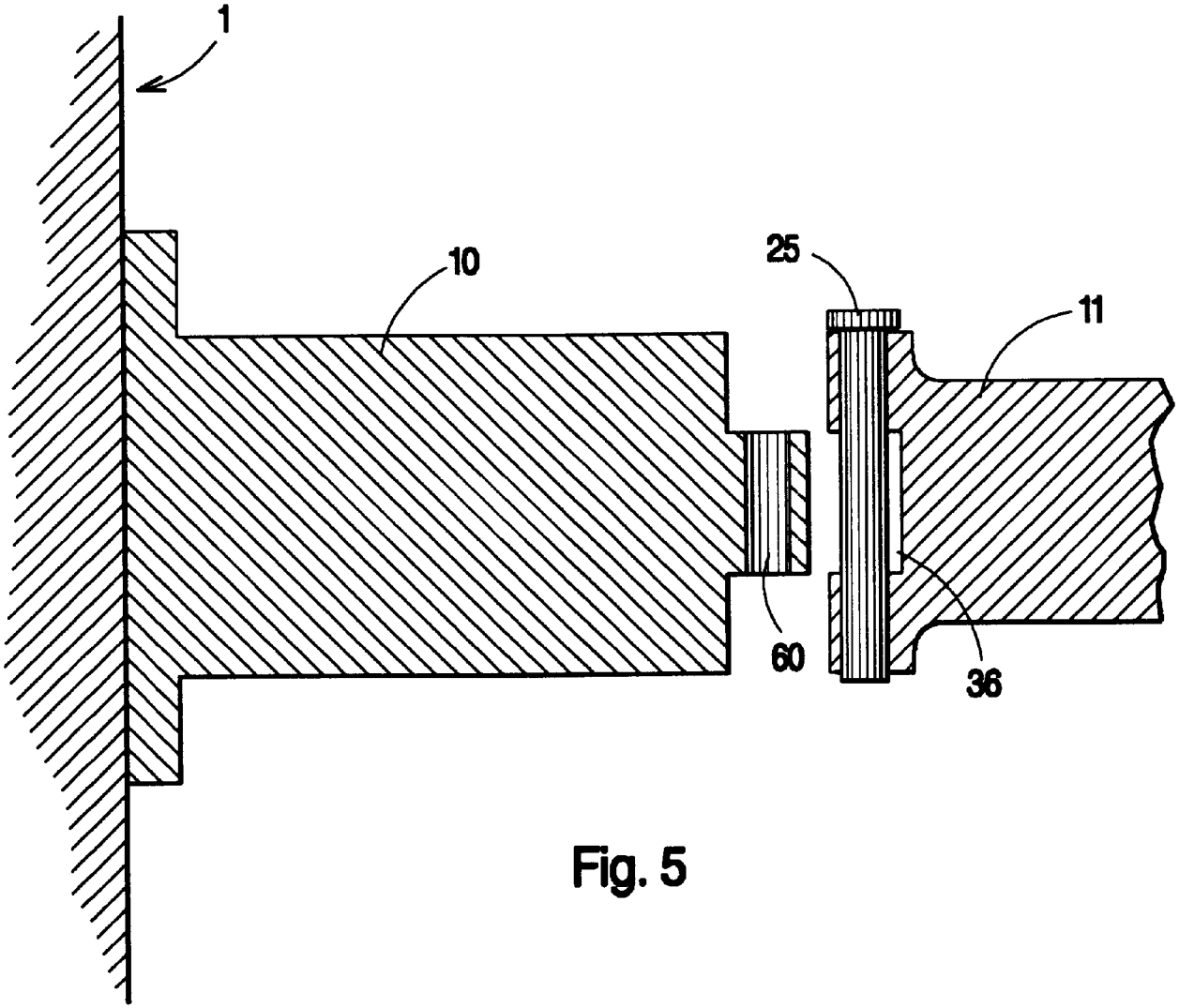
FIG. 5 is a sectional detail showing how, with the connector removed, the cross head extension can be directly coupled to the piston link to aid piston withdrawal.
Figure 6:
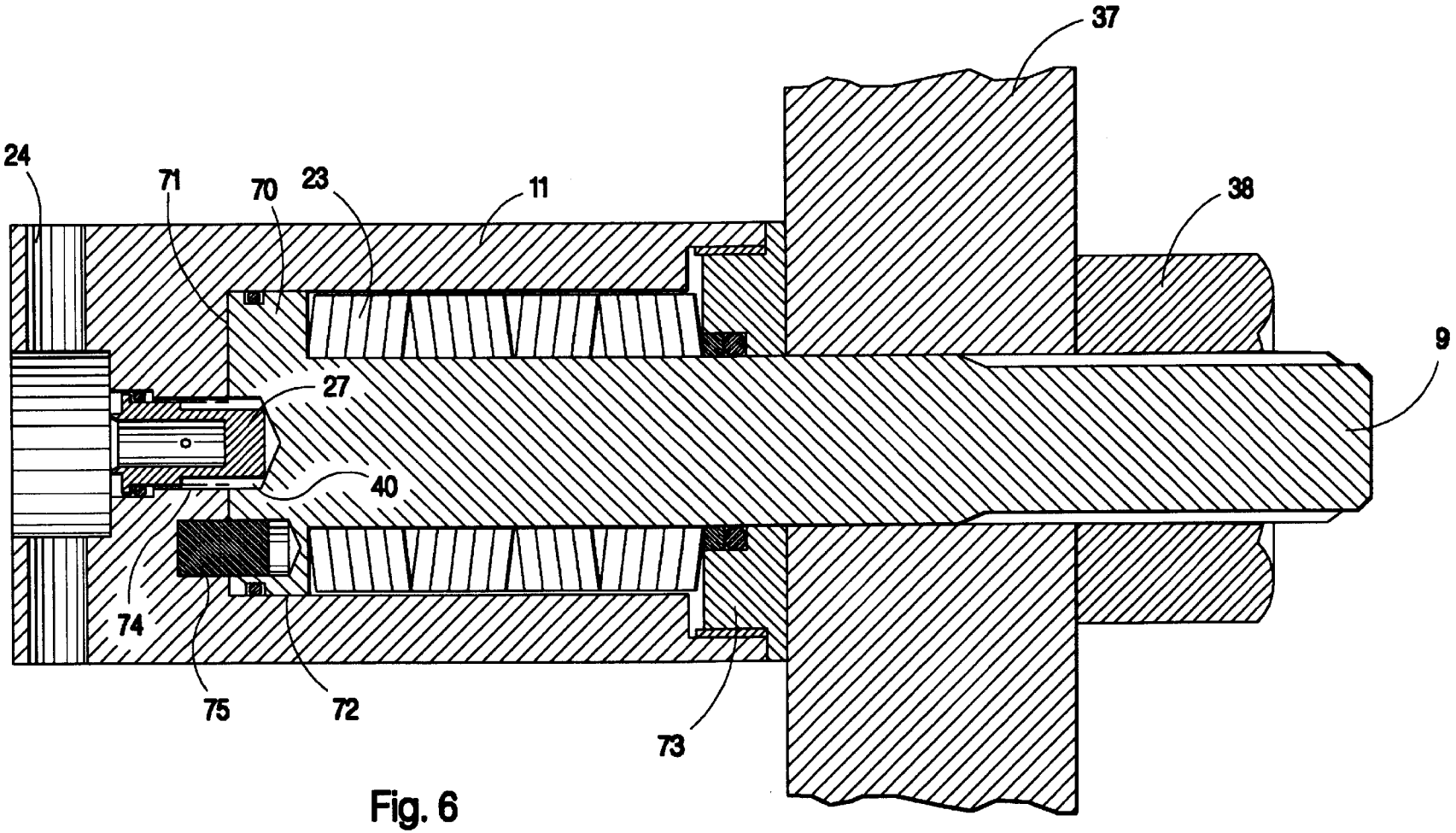
FIG. 6 is a sectional detail of the part of the piston rod assembly according to the invention showing the piston link with the piston attached.

Referring now to FIGS. 3 and 4, the chamber 22 and 122 in FIGS. 1 and 1*a*, respectively, or 71 in FIG. 6 communicates with an opening 26 (FIG. 1) or 74 (FIG. 6) in the wall of the connector body 13 or the piston link 11 via a fluid inlet/outlet device 27 which is inserted into the opening 26 or 74. The device 27 has a filling body 82 which has a series of radial through passages 28 communicating with the central passage 29 whereby pressurising fluid entering the device 27 exits into chamber 22 or 71 via the radial passages 28. The pressurising fluid is preferably supplied by a speed hand pump and is retained by closing the check-valve on the hand pump. In order to relieve the pressure in chamber 22, the check valve on the hand pump is opened.

The pressurising fluid is inserted into the device by a nozzle 30, as shown in FIG. 4, which has a fluid passage 31 having an axial run and a bend to exit radially between two pressure seals 80,81. The nozzle is designed so that the radial outlet feeds into the radial passages 28 in the device 27. The nozzle 30 also has a pressure equalizing bleed hole 33 which has an axial run from the inner end 34 of the nozzle and a bend to exit through the side of the nozzle at 35 to atmosphere. Thus, excess fluid lying in the central passage 29, shown in FIG. 3 is forced out to atmosphere when pushing the nozzle 30 into the device 27. The nozzle is for example, attached to a H P source such as an hydraulic hand pump.

Referring again to FIG. 2, the cross head extension rod 10 terminates in a male coupling 60 by which the cross head extension rod 10 can be coupled to the release link connector 12. All the various pump manufacturers have different cross head extension designs. All of these designs are flawed in that premature failure may take place due to their system of clamping. Several different cross head extension rods 10 are therefore produced to suit the various power ends. All have the same configuration on the male coupling 60 to connect with the release link 12.

Referring again to FIG. 1, it can be seen that the connecting tension link 24 is rotatable whilst the space 22 is pressurised. This is necessary in order that the pin aperture 15 in the piston link 11 may be aligned with the pin aperture 24 in the release link 12. Other known release links using pins in shear type connections do not allow rotation, thus making pin alignment very difficult. Also it is desirable to occasionally turn piston heads 37 within the pump bore in order to "even" their wear pattern. This is effected quickly and simply by pressurising the chamber 22 thus releasing the shear force on the pin 25 and consequently the friction force between the release link 12 and the piston link 11. The piston link 11 is then rotated using a conventional wrench. This process takes approximately 30 seconds whereas the same process using known clamp systems takes approximately 15 minutes and with known pins in shear type systems it is even longer.

The high pressure reciprocating slush pump as hereinbefore described may be provided with a universal connector which can quickly connect and disconnect for quick make-up or quick release of the piston rod assembly.

The piston rod assembly as hereinbefore described also takes account of other problems that can exist with mud pumps. For example, accumulation of sand and other solids under the sealing element of the piston against the cylinder wall can cause damage to the element and excessive wear on the sealing element and cylinder wall. The clearance between the piston and the cylinder wall increases due to this wear which increases the difficulty of the piston retaining its seal with the cylinder wall. The pump described herein provides a wash pipe to locate cooling and flushing fluid as close as possible to the heat generator (piston). The existing systems require the feed pipework to be disconnected from the rod system prior to dismantling the rod. Referring to FIG. 2, a wash pipe 85 is attached to the pin 25, thus allowing the complete wash system to be lifted clear while still attached to the feed pipework.

Also it is necessary to use a substantial force to pull the piston link 11, with the piston head 37, attached from the pump. All existing systems require special tools and adaptors to pull the piston link 11 and piston head 37 from the pump. This invention has a male coupling means 60 on the cross head extension rod 10 which mates directly with the female coupling 36 on the piston link 11. When the release link connector 12 is removed, the cross head extension rod 10 is driven forward until the male coupling 60 and female coupling 36 are aligned. The pin 25 is then fitted into the aperture 24 thus joining the cross head extension rod 10 and the piston link 11. The cross head extension rod 10 is then driven backwards towards the power end thus withdrawing the piston head 37 from the pump.

At the power end of a mud pump, the cross head extension rod passes through a bulkhead where it is engaged by a seal; on one side of the bulkhead the rod is immersed in oil, and on the other side it is in an environment that contains mud and other corrosive and abrasive substances and as a result the outer surface of the rod is subject to wear which in turn damages the seal. A disadvantage of some known intermediate extension rods is that the end for connection to the release link has a larger diameter than the body thus preventing easy replacement of the bulkhead seal; at present, the cross head extension rod must first be disconnected from the cross head and removed so that the worn seal can be removed and replaced. The rod system described herein provides a cross head extension rod that is parallel and that will allow easy replacement of a worn bulkhead seal.

At the fluid end of the rod assembly it is necessary to attach the piston to the piston link using a retainer, which in the example embodiment illustrated comprises a threaded nut. Existing systems require a large torque to be applied to the nut with a wrench causing damage to the components and requiring a high degree of operator skill. The invention removes the requirement for both large tightening torques and operator skill to achieve correct tightening.

Modifications may be made without departing from the scope of the invention. For example, with reference to FIG. 1, the pistons 16 and 21 may be moved by mechanical means such as a cam, housed in the chamber 22, and actuated by a key inserted through an aperture in the side of the connector body. Also, the spring means may be other than springs 23.

Also the invention is also applicable to dynamic components other than pistons, and is intended to encompass plungers and the like.

The H P reciprocating mud pump rod system as hereinbefore described has many advantages. For example the release link connector 12 allows for very quick make-up and dismantling of the piston rod. The removable wash pipe 85 is positioned to bring the source of cooling water as close as possible to the heat-generating piston head and is easily and quickly removed. The quick release fitting provides an High Pressure fitting that can be quickly assembled and disassembled without external fasteners. It is inherently safe and cannot blow apart when pressurised. The rod system has a "built in" piston removal tool. The system allows power end seals to be replaced without removal of the cross head extension rod. The system allows for fast accurate tightening and releasing of the piston nut 38.

We claim:

1. A piston rod assembly comprising a power end component, a fluid end component and a connector, said connector having a body member and first and second tension links, said body member having a radial aperture therein, said power end component and said fluid end component each having a respective coupling pin, wherein said first tension link has an aperture which is releasably engageable with said power end component coupling pin by insertion of said power end component coupling pin through both said aperture in said first tension link and said radial aperture in said body member, such that said first tension link does not extend beyond the axial limit of said body member when said aperture in said first tension link is aligned with said radial aperture in said body member, and wherein said second tension link has an aperture which is releasably engageable with said fluid end component coupling pin, said connector further including biasing means for biasing the links such that said coupling pins, when engaging said apertures, are held in shear to resist uncoupling thereof, said connector further including first and second pistons connected to said first and second tension links respectively with the heads of said pistons disposed in back to back relation, said body member including a chamber in which said pistons may slide and an opening located between said piston heads for the supply of pressurised fluid to said chamber to cause movement of said first and second tension links against the bias of said biasing means to co-operative disposition of said coupling pins and said respective apertures.

2. A piston rod assembly as claimed in claim 1, wherein said connector is cylindrical and has a longitudinal axis, said first tension link being mounted within said connector such that it is free to rotate about said longitudinal axis relative to said connector, said second tension link being mounted within said connector such that it is restrained from rotation about said longitudinal axis relative to said connector.

3. A piston rod assembly as claimed in claim 1, wherein said biasing means comprises first and second mechanical springs acting between said connector and said first and second pistons respectively.

4. A piston rod assembly as claimed in claim 1, wherein said power end component has a male coupling portion and said first tension link has a female coupling portion, wherein said female coupling portion of said first tension link does not extend beyond said connector in the coupled state.

5. A piston rod assembly as claimed in claim 4, wherein said fluid end component has a male coupling portion and said second tension link has a female coupling portion, wherein said female coupling portion of said second tension link does not extend beyond said connector in the coupled state.

6. A piston rod assembly as claimed in claim 1 wherein the fluid end component is a piston link which is coupled to the connector, wherein the piston rod assembly further comprises a piston head which is retained on the piston link by a mechanical retainer, and wherein the mechanical retainer and piston link are forcibly biased by a spring acting between the piston head and the piston link in a direction adapted to tighten the retainer on the piston link.

7. A piston rod assembly as claimed in claim 6, wherein the mechanical retainer comprises a stud piston and wherein the piston link is provided with a cylindrical bore in which said stud piston may slide, said cylindrical bore having an opening located between said stud piston and the end of the cylindrical bore for the supply of pressurised fluid to said cylindrical bore to cause movement of the piston head and mechanical retainer against said bias to assist in the removal of said retainer and thereafter said piston head from said piston link.

8. A piston rod assembly as claimed in claim 6 wherein the retainer is a nut threaded on the piston link.

9. A piston rod assembly as claimed in claim 6 further including a dowel mounted in said piston link which engages a recess in said stud piston for preventing rotation of the piston link.

10. A piston rod assembly as claimed in claim 6 wherein the piston rod assembly further comprises a fluid inlet/outlet device for supplying pressure fluid into or out of the chamber in said body member between the pistons of the connector and the cylindrical bore in said piston link, wherein the fluid inlet/outlet device comprises, in combination, a filling body having one or more radial fluid outlet passages associated with a central passage for the injection of fluid into internal openings of the radial passages in the filling body and an inlet nozzle for injecting pressurised fluid into the filling body, said nozzle being adapted for location in the central passage of the filling body and having a longitudinal fluid inlet passage which bends through an angle to exit from the side of the nozzle between two pressure seals and align with the radial fluid inlet passage of the filling body, the nozzle also having a separate pressure equalising bleed hole which extends through the nozzle from the end of the nozzle when the nozzle is pushed into the body.

11. A piston rod assembly as claimed in claim 1 wherein at least one of said coupling pins is attached to a wash pipe.

* * * * *

UNITED STATES PATENT AND TRADE MARK OFFICE

CERTIFICATE OF CORRECTION

PATENT NO. : 5,904,071
DATED : May 18, 1999
INVENTOR(S) : Kennedy et al.

It is certified that error appears in the above-identified patent and that said Letters Patent is hereby corrected as shown below:

Cover Page:

[73] Assignee: P-Quip Limited,
Kilmacolm, United Kingdom

Signed and Sealed this

Twenty-second Day of August, 2000

*Attest:*

Q. TODD DICKINSON

*Attesting Officer*

*Director of Patents and Trademarks*